US008269403B2

(12) United States Patent
Yang et al.

(10) Patent No.: US 8,269,403 B2
(45) Date of Patent: Sep. 18, 2012

(54) COOLING SYSTEM OF LED LIGHT USING HEAT OF VAPORIZATION AND LED LIGHT INCLUDING THE SAME

(75) Inventors: Sang-Mo Yang, Seoul (KR); Jae-Boong Choi, Yongin-si (KR); Seung-Won Yeum, Yongin-si (KR)

(73) Assignee: Sungkyunkwan University Foundation for Corporate Collaboration, Gyeonggi-Do (KR)

( * ) Notice: Subject to any disclaimer, the term of this patent is extended or adjusted under 35 U.S.C. 154(b) by 612 days.

(21) Appl. No.: 12/503,359

(22) Filed: Jul. 15, 2009

(65) Prior Publication Data

US 2010/0013367 A1 Jan. 21, 2010

(30) Foreign Application Priority Data

Jul. 17, 2008 (KR) ..... 10-2008-69372

(51) Int. Cl.
*H01J 61/52* (2006.01)

(52) U.S. Cl. ..... 313/46; 257/89

(58) Field of Classification Search ..... 313/484–487, 313/498, 489, 512, 467, 468, 499, 501–503; 257/98, 99, 100, 79–81; 362/235, 227, 231, 362/293, 545, 800; 345/44, 46; 438/22, 438/26, 458

See application file for complete search history.

(56) References Cited

U.S. PATENT DOCUMENTS

2005/0258438 A1* 11/2005 Arik et al. ..... 257/88
2008/0089029 A1* 4/2008 Launay et al. ..... 361/697
2009/0122570 A1* 5/2009 Hsu et al. ..... 362/545

FOREIGN PATENT DOCUMENTS

JP 2004327533 A * 11/2004
KR 20/0336197 Y1 12/2003
KR 10/0822032 B1 4/2008

* cited by examiner

*Primary Examiner* — Anh Mai
*Assistant Examiner* — Elmito Breval
(74) *Attorney, Agent, or Firm* — Brian R. Morrison; Westman, Champlin & Kelly, P.A.

(57) ABSTRACT

A cooling system of an LED light employs a dehumidifying agent absorbing moisture in the air while the LED light is turned off, and dissipates heat from the LED light using heat of vaporization by vaporization of the moisture by heat from the LED light when the LED light is turned on. The system includes an LED module, a thermal sheet, a heat pipe, a heat sink, and a dehumidifying sheet. The LED module includes a PCB and multiple LEDs, and the thermal sheet is disposed on the LED module. The heat pipe of a cornered U-shape has a circular cross section and is coupled to a connector on the thermal sheet. The heat pipe has a horizontal section contacting an upper side of the thermal sheet and a vertical section protruding to the connector. The dehumidifying agent is disposed on the heat sink inserted into the heat pipe.

19 Claims, 13 Drawing Sheets

COOLING SYSTEM OF LED LIGHT USING HEAT OF VAPORIZATION AND LED LIGHT INCLUDING THE SAME

CROSS-REFERENCE TO RELATED APPLICATION(S)

This application claims the benefit of Korean Patent Application No. 10-2008-69372, filed with the Korean Intellectual Property Office on Jul. 17, 2008, the disclosure of which is incorporated herein by reference in its entirety.

BACKGROUND

1. Technical Field

The present invention relates to a cooling system of an LED light using heat of vaporization and an LED light including the same. More particularly, the present invention relates to a cooling system of an LED light using heat of vaporization and an LED light including the same, which employ a dehumidifying agent absorbing moisture in the air while the LED light is turned off, and dissipates heat generated from the LED light using heat of vaporization caused by vaporization of the absorbed moisture by heat from the LED light while the LED light is turned on.

2. Description of the Related Art

In general, a lighting apparatus converts electrical energy into light energy and provides light for recognition or irradiation of objects indoors or outdoors at night. In recent years, the lighting apparatus is also used for indoor decorative lighting or display with colored lights using an incandescent lamp, fluorescent lamp, halogen lamp, metal halide lamp, mercury lamp, sodium-vapor lamp, and the like.

Despite inexpensiveness, however, the incandescent lamp has a shorter lifespan, inferior light emitting efficiency, and high brightness resulting in glare. The fluorescent lamp has higher energy efficiency and low power consumption than the incandescent lamp, but has longer standby time for lighting and a shorter lifespan. The sodium-vapor lamp, mercury lamp, and metal halide lamp involve greater power consumption, which causes glare and a shorter lifespan.

To overcome such problems, it has been attempted to develop a light emitting diode (LED)-based light that is semi-permanent, consumes less power, and provides high-efficiency luminescence. Currently, the LED-based light is widely used for various applications.

Use of the LED light has been gradually expanded due to its merits in view of fast processing speed, low power consumption, environmental friendliness, and high energy efficiency. Moreover, since the LED light consumes 60 to 80% less power than a common light, has a semi-permanent lifespan of 50,000 hours or more, and does not cause glare, it has received a great deal of attention in the field of lighting apparatuses.

However, since the LED light includes multiple LEDs mounted on a printed circuit board (PCB), it emits a great deal of heat. Thus, if heat generated inside is not properly discharged or dissipated while the LED light is turned on for a predetermined time, the LED light will undergo efficiency deterioration. Further, when the LED light is used for a long time, the lifespan of the LED light decreases.

In order to solve such problems, Korean Utility Registration No. 336197 discloses a method of cooling an LED light which includes a small cooling fan to forcibly circulate and discharge heat generated when the LED light is turned on, thereby cooling the LED light. The method employs a mechanical component, i.e. the fan, thereby causing a complicated structure, a rise in manufacturing costs, a risk of malfunction, and an increase in volume of a system. Moreover, additional heat is generated during operation of the cooling fan.

Korean Patent Registration No. 822032 discloses a natural cooling method using air as a medium. Referring to FIG. 1, when power is applied to turn on an LED 1, light is emitted from an LED light unit 3 inside a lampshade 2 and the LED light unit 3 is gradually heated. Then, a natural convection pipe 4 is heated, so that air in the natural convection pipe 4 is heated. The heated air in the natural convection pipe 4 rises into a light socket 5, flows into a plug main body 7 through a ventilation hole 6, and is discharged to the outside from the plug main body 7 through a through-hole 9 and a vent 10 of a power contact unit 8.

The method dissipates heat of the LED light unit 3 by air convection where the heated air in the natural convection pipe 4 rises so as to be discharged to the outside through the vent 10 and cold air flows into the convection pipe 4 from the outside. In the method, air is used as a medium for cooling to reduce costs of repair and maintenance, while heat discharge is limited by weather and climate changes, thereby reducing cooling efficiency.

SUMMARY

The present invention is conceived to solve the problems of the related art, and an aspect of the invention is to provide a cooling system of an LED light using heat of vaporization and an LED light including the same, which smoothly discharge and eliminate heat generated in the LED light when the LED light is turned on and used for a predetermined time to improve efficiency of the LED light and to extend lifespan thereof.

Another aspect of the invention is to provide a cooling system of an LED light using heat of vaporization and an LED light including the same, which do not include an additional mechanical component for cooling to reduce costs of repair and maintenance and to reduce manufacturing costs through simplification of the structure of the system while reducing the size thereof.

A further aspect of the present invention is to provide a cooling system of an LED light using heat of vaporization and an LED light including the same, which do not suffer restrictions in heat discharge by weather and climate changes, do not need an additional energy source, thus being environmentally friendly, and have high cooling efficiency.

In accordance with one aspect, the invention provides a cooling system of an LED light using heat of vaporization includes a heat sink and a dehumidifying agent provided on the heat sink. Here, the LED light employs an LED module including an LED as a light. The dehumidifying agent may comprise at least one of lithium chloride (LiCl), MCM, activated alumina, and zeolite. The system may further include a dehumidifying sheet provided on the heat sink and accommodating the dehumidifying agent. Here, the dehumidifying sheet includes a case accommodating the dehumidifying agent. The system may further include a filter protecting the dehumidifying agent. Here, the case accommodates the dehumidifying agent and the filter. The system may further include a thermal sheet disposed on the LED module; a connector disposed on the thermal sheet; and a heat pipe transferring heat generated in the LED module from the thermal sheet to the connector. The heat pipe may include a horizontal heat pipe section and vertical heat pipe sections bent and extending from opposite ends of the horizontal pipe, and the vertical pipe sections may penetrate the heat sink and the dehumidifying sheet. The heat pipe may include multiple heat pipes disposed at regular intervals in a width direction of the LED module. The dehumidifying sheet may be disposed separately inside and outside vertical sections of the multiple heat pipes.

The heat sink may include: a first heat sink which includes a first vertical section, and first and second horizontal sections bent and extending from opposite ends of the first vertical section; and a second heat sink which includes a second vertical section, and third and fourth horizontal sections bent and extending from opposite ends of the second vertical section, and the first vertical section may fixedly adjoin the second vertical section. The heat sink may include a plurality of the first heat sinks and a plurality of the second heat sinks. Here, the first vertical sections have different lengths from each other, the second horizontal section have different lengths from each other, the second vertical sections have different lengths from each other, and the fourth horizontal sections have different lengths from each other, and the first vertical section fixedly adjoin the second vertical section. The first horizontal section may include a first opening formed therethrough, the third horizontal section may include a second opening formed therethrough, and the dehumidifying agent may be provided on both sides of the first horizontal section including the first opening and on both sides of the third horizontal section including the second opening. The system may further include a filter provided on the dehumidifying agent. The filter may include a semi-transparent layer. The semi-transparent layer may comprise polytetrafluoroethylene. The system may further include an adherent member to bond the semi-transparent layer to the heat sink. The adherent member may comprise one of high-temperature vinyl acetate, high-temperature epoxy, and room temperature vulcanizing (RTV) high-temperature silicone.

In accordance with a further aspect, the invention provides an LED light including an LED module and a cooling system that cools the LED module and includes a heat sink having a dehumidifying agent. The cooling system may further include a dehumidifying sheet provided on the heat sink and accommodating the dehumidifying agent and the dehumidifying sheet may include a case accommodating the dehumidifying agent and a filter coupled to the case to protect the dehumidifying agent. The LED light may further include an opening formed in the heat sink, wherein the dehumidifying agent is provided on the heat sink including the opening. The LED light may include a filter sealing the dehumidifying agent provided on the heat sink comprising the opening. The dehumidifying agent may comprise lithium chloride (LiCl), and the filter comprises a semi-transparent layer.

With the foregoing features, the cooling system of an LED light using heat of vaporization according to the embodiments of the invention cools the LED light using natural heat of vaporization. In the system, when the LED light is turned on, heat is generated and heats a dehumidifying agent in a dehumidifying sheet through a thermal sheet, multiple heat pipes, and a heat sink, so that moisture absorbed by the dehumidifying agent in turning off the LED light is vaporized and absorbs heat from the surroundings, thereby decreasing temperature. Thus, the cooling system does not require an additional cooling component, thereby decreasing costs of repair and maintenance and reducing manufacturing costs through simplification of the structure of the system while reducing the size thereof. Further, the cooling system employs a semi-permanent recyclable dehumidifying agent, which does not require an additional energy source when operating so as to be environmentally friendly and is capable of overcoming restrictions in heat discharge by weather and climate changes, thereby achieving substantial efficiency and reduction in power consumption.

BRIEF DESCRIPTION OF THE DRAWINGS

The above and other aspects, features and advantages of the invention will become apparent from the following description of embodiments given in conjunction with the accompanying drawings, in which.

DETAILED DESCRIPTION

Exemplary embodiments of the invention will be described in detail with reference to the accompanying drawings hereinafter.

Figure 1:
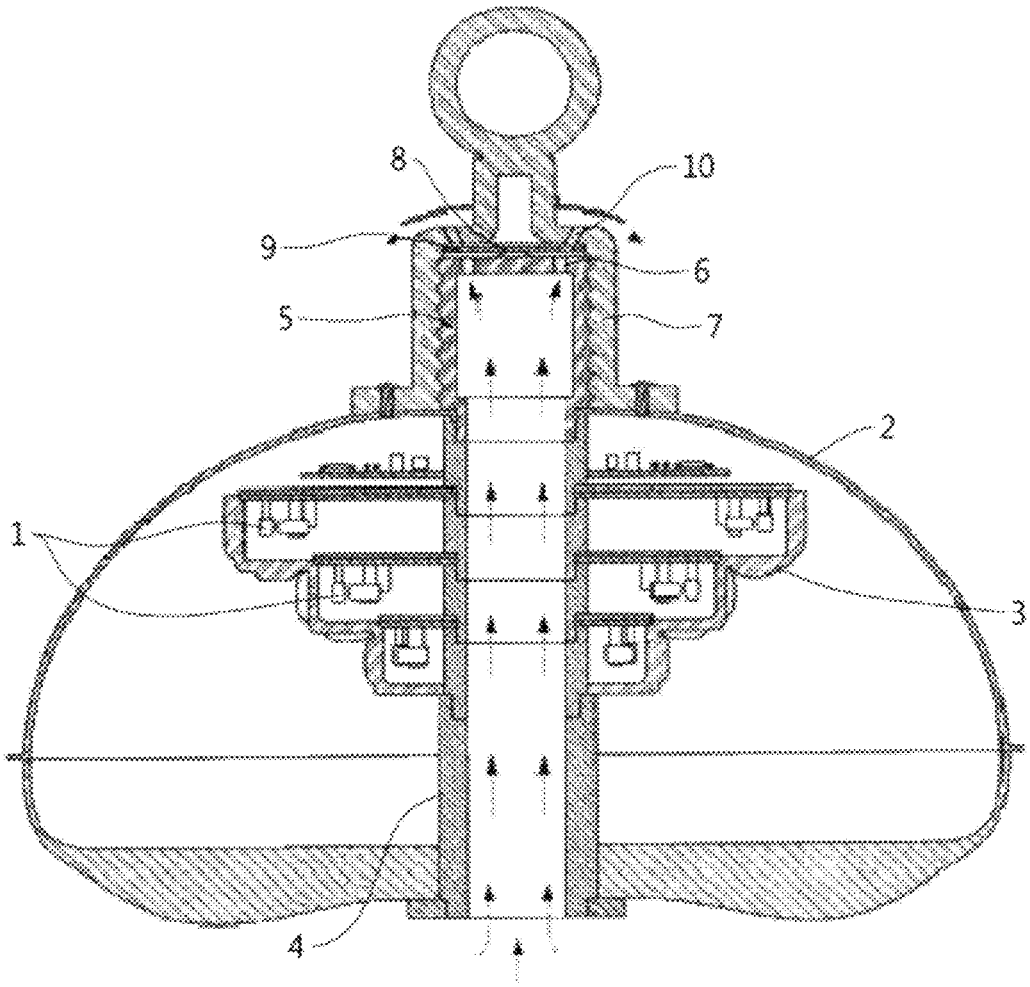
FIG. 1 is a cross-sectional view of a conventional cooling system of a light emitting diode (LED) light.
Figure 2:
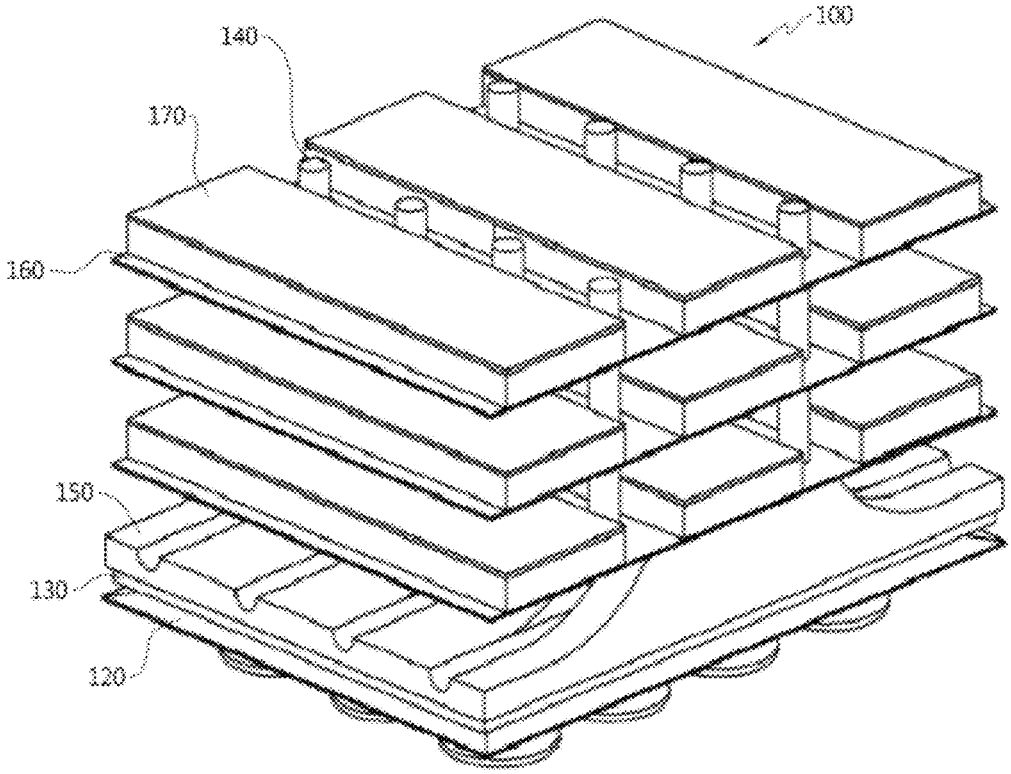
FIG. 2 is an assembly view of a cooling system of an LED light according to a first embodiment of the present invention.
Figure 3:
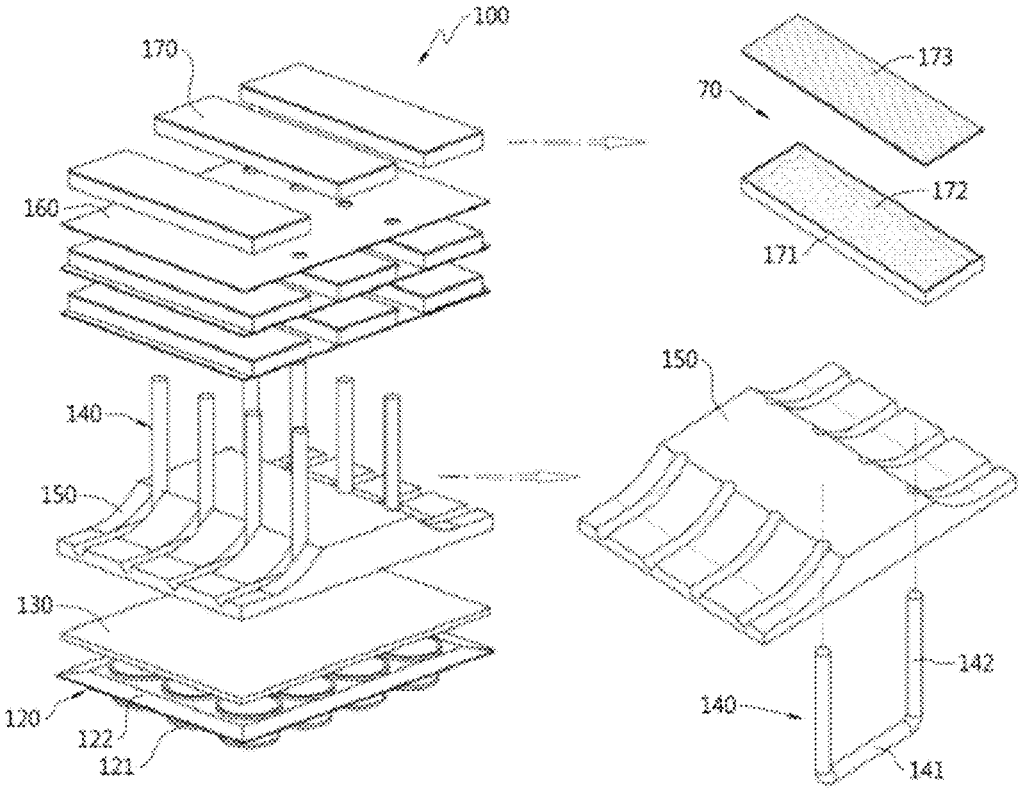
FIG. 3 is an exploded perspective view of the cooling system according to the first embodiment of the present invention.
Figure 4:
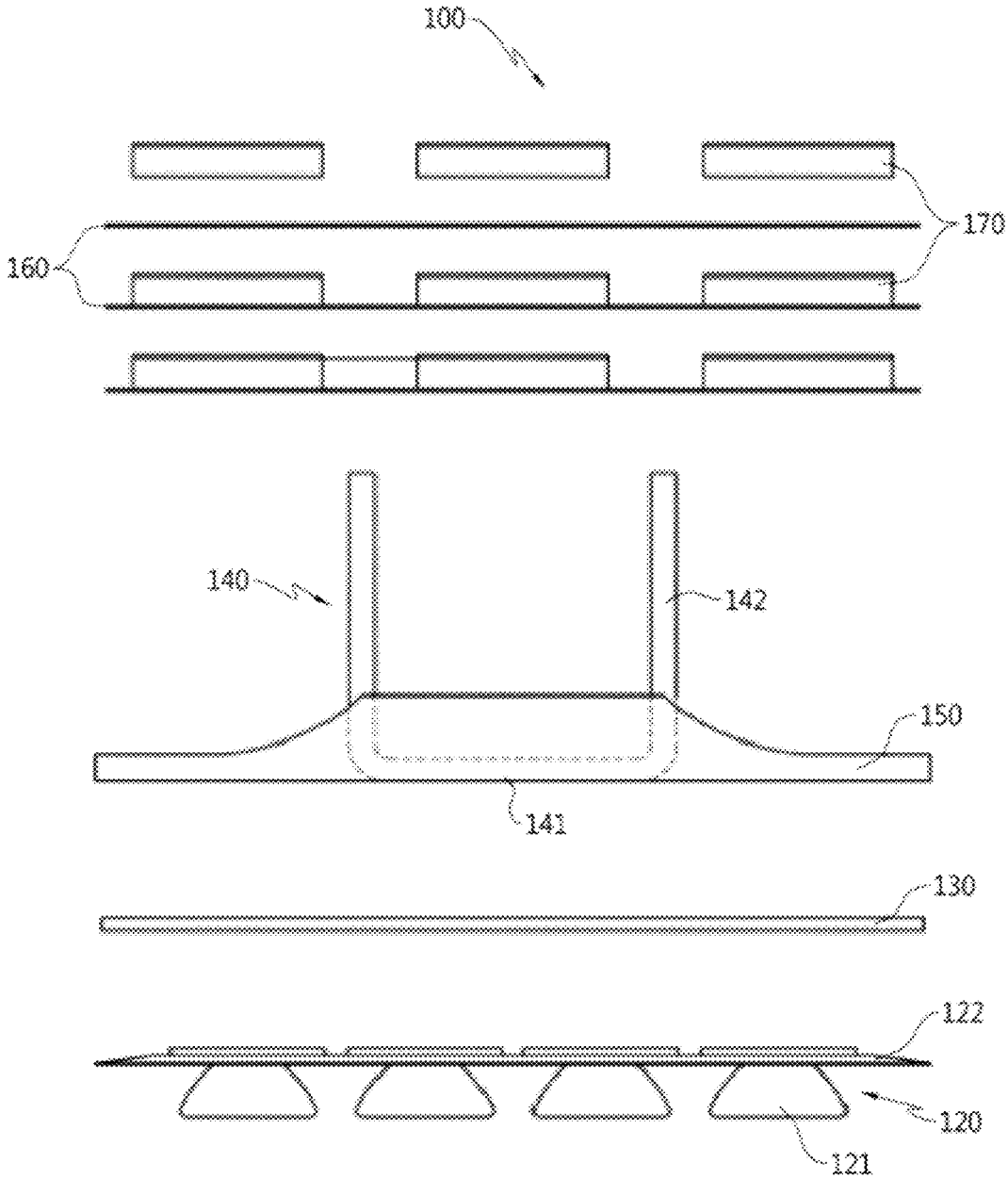
FIG. 4 is a longitudinal cross-sectional view of the cooling system according to the first embodiment of the present invention.

Firstly, a cooling system for a light employing heat of vaporization according to a first embodiment of the invention will be explained with reference to FIGS. 2 to 4.

A cooling system of an LED light using heat of vaporization according to the first embodiment of the invention includes a thermal sheet 130, multiple heat pipes 140, a connector 150, a heat sink 160, and a dehumidifying sheet 170. Here, the cooling system of the LED light is mounted on an LED module.

The LED module 120 is an object to be cooled by the cooling system and includes multiple LEDs 121 mounted on a printed circuit board (PCB) 122. The thermal sheet 130 is disposed on an upper side of the LED module 120, i.e. on the PCB 122, to transfer heat from the LEDs 121 to the heat pipes 140 when the LEDs 121 are turned on and generate heat. Here, the LED module 120 may be provided with at least one LED 121. However, as the number of LEDs 121 increases, the LED module 120 has higher brightness. Thus, a plurality of LEDs 121 may be provided to enhance the brightness of the LED module 120.

The PCB 122 has an uneven surface, so that when the heat pipes 140 are directly mounted on the PCB 122, a small contact area is provided therebetween, thereby decreasing heat transfer efficiency. Thus, the thermal sheet 130 is provided as a heat transfer medium to increase a contact area between the PCB 122 and the pipes 140. The PCB 122 supports the LEDs 121 and is formed with a circuit (not shown) to supply an electric current to the LEDs 121.

The heat pipes 140 are provided to improve thermal efficiency and quickly conduct heat to the heat sink 160 when the heat is generated from the LED module 120 and transferred through the thermal sheet 130. The heat pipes 140 are fixedly coupled to the connector 150 disposed on the thermal sheet 130. Further, each of the heat pipes 140 includes a horizontal heat pipe section 141 and vertical heat pipe sections 142, which are bent and extend from opposite ends of the horizontal heat pipe section 141. Here, the heat sink 160 is separately disposed between the vertical heat pipe sections 142 being opposite to each other and outside the vertical heat pipe sections 142. In this embodiment, the heat pipes 140 are illustrated as having a cornered U-shape and a circular cross section but the invention is not limited thereto. Alternatively, the heat pipes 140 may have a semi-oval, semi-circular, oval, circular, or polygonal cross-section. The heat pipes 140 are provided to the system such that the horizontal heat pipe section 141 contacts the thermal sheet 130 and the vertical heat pipe sections 142 protrude from the connector 150. Further, the multiple heat pipes 140 may be advantageously arranged at regular intervals in the width direction of the LED module 120.

The heat sink 160 discharges heat from the LED module 120 to the outside. In this embodiment, the heat sink 160 is illustrated as a tetragonal heat sink, but the invention is not limited thereto. Alternatively, a circular, oval or polygonal plate may be used as the heat sink 160. That is, the heat sink 160 is not limited to a specific shape so long as it can effectively discharge heat from the LED module 120.

The dehumidifying sheet 170 is located on the heat sink 160. The dehumidifying sheet 170 includes a case 171, a dehumidifying agent 172 disposed inside the case 171, and a filter 173 mounted on the case 171. The dehumidifying agent 172 serves to absorb moisture in the air. The filter 173 serves to protect the dehumidifying agent 172 from foreign matter such as dust, so that the dehumidifying agent 172 can be used for a long time. The case 171 may be made of a material having a high thermal conductivity, such as copper or the like. If the heat sink 160 is disposed at an angle rather than horizontally, an additional absorbent medium for absorbing a dehumidifying agent (liquid) is provided to prevent the dehumidifying agent from being leaked from the case 171.

Next, the cooling system according to this embodiment will be described in detail.

While the LEDs 121 are turned off, the dehumidifying agent 172 absorbs moisture in the air. When the LEDs 121 are turned on, heat is generated from the LEDs 121, i.e. the LED module 120, and is sequentially transferred to the thermal sheet 130, the plural heat pipes 140 fixed to the connector 150, and the heat sink 160.

When heat radiated from the heat sink 160 is transferred to the dehumidifying sheet 170, the dehumidifying agent 172 having absorbed the moisture in the case 171 of the dehumidifying sheet 170 is subjected to the heat. As a result, the moisture in the dehumidifying agent 172 is evaporated while absorbing heat from the heat sink 160 to decrease temperature, thereby cooling the LED module. The dehumidifying agent 172 may be formed of a reusable material, such as lithium chloride LiCl, which can be recycled when moisture is vaporized.

Hereinafter, a cooling system for a light using heat of vaporization in which a heat pipe is not included according to a second embodiment of the invention will be explained with reference to FIGS. 11 to 13.

Figure 11:
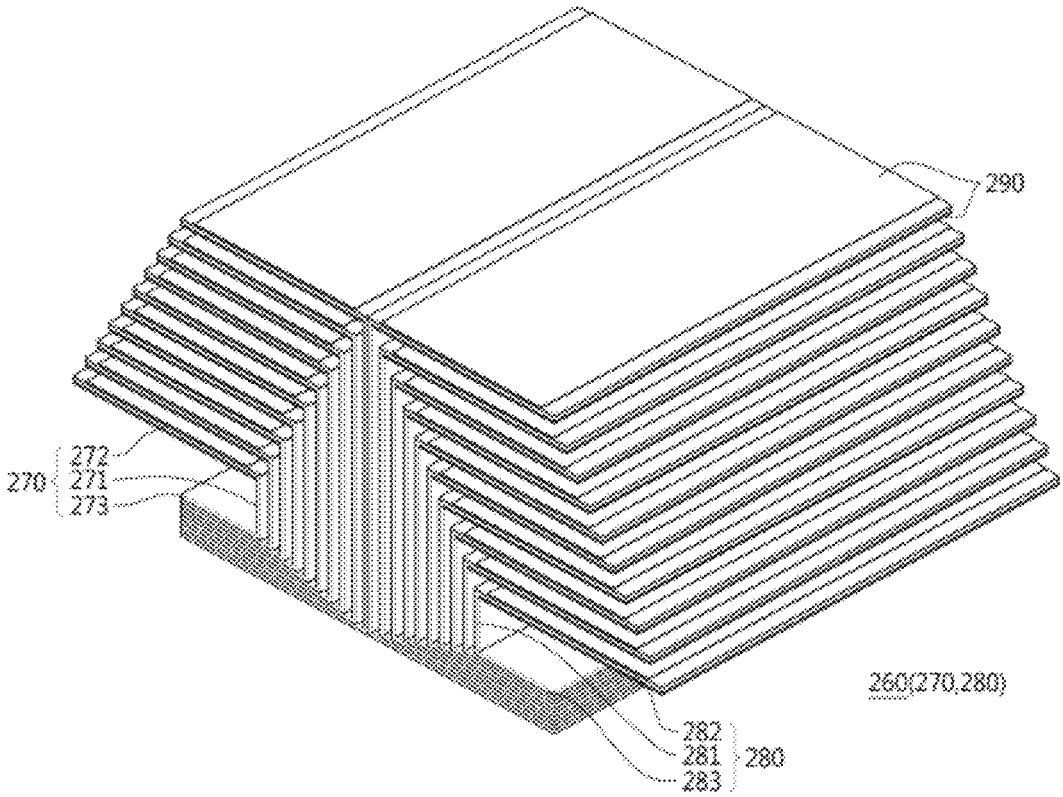
FIG. 11 is a perspective view of a cooling system of an LED light according to a second embodiment of the present invention.
Figure 12:
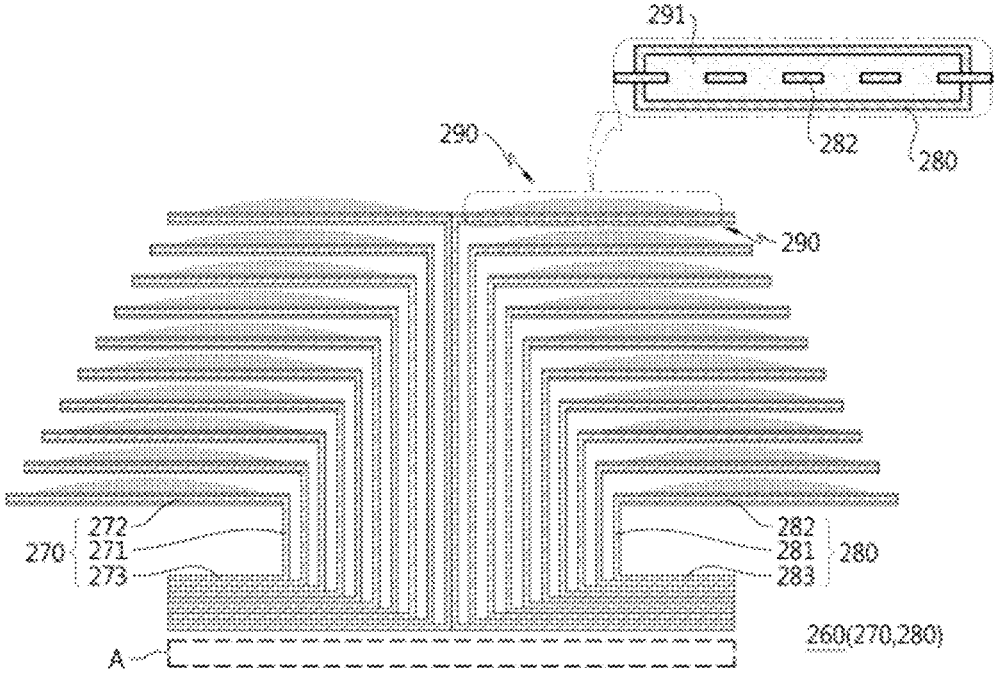
FIG. 12 is a cross-sectional view of the cooling system according to the second embodiment of the present invention.
Figure 13:
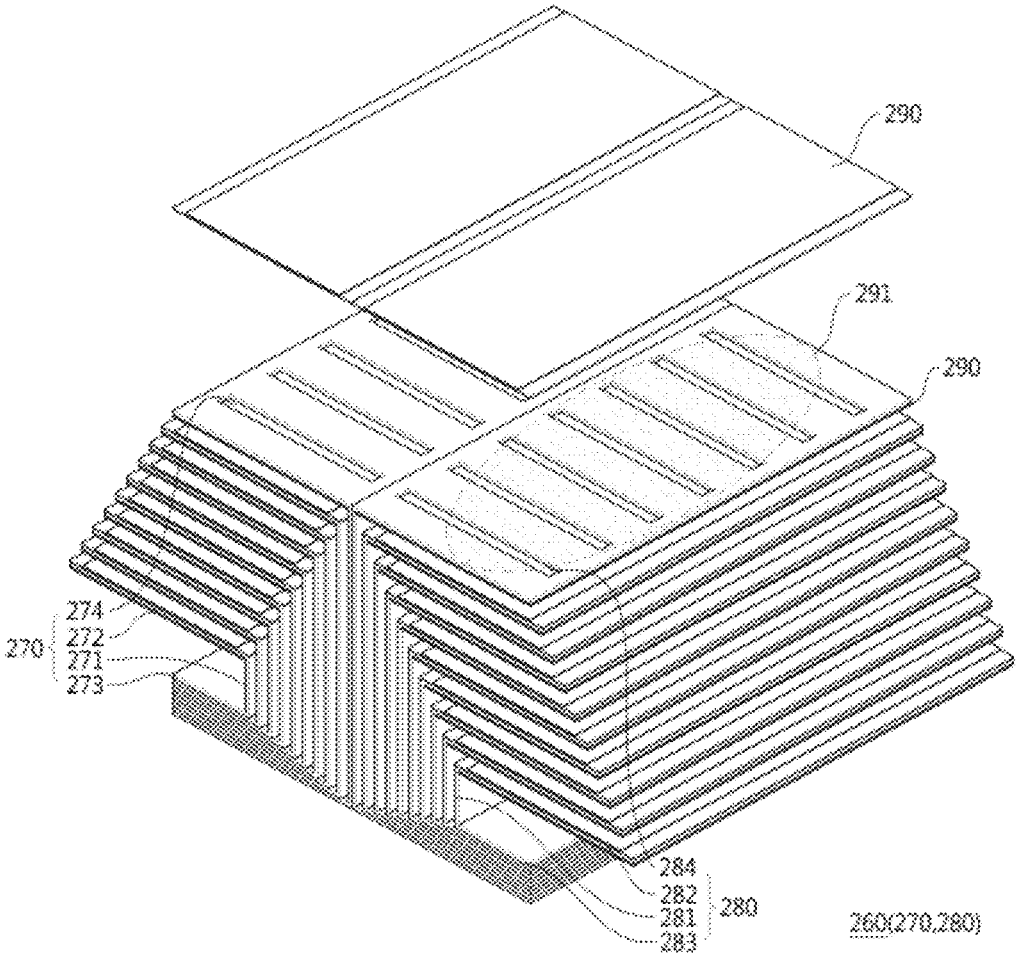
FIG. 13 is a schematic exploded perspective view of the cooling system light according to the second embodiment of the present invention.

Referring to FIGS. 11 to 13, a cooling system of an LED light using heat of vaporization according to the second embodiment includes a heat sink 260, a dehumidifying agent 291, and a filter 290. Here, an LED module acting as a light source and including LEDs may be disposed at Position A, thereby constituting a lighting apparatus having the cooling system.

The heat sink 260 quickly discharges heat from the LED module to the outside and includes first heat sink 270 and second heat sink 280.

The first heat sink 270 includes a first vertical section 271, and first horizontal section 272 and second horizontal section 273 which are bent and extend from opposite ends of the first vertical section 271. In other words, the first heat sink 270 may have a cornered C-shape. Further, the first horizontal section 272 of the first heat sink 270 is formed with a first opening 274 which accommodates the dehumidifying agent 291. In this embodiment, multiple rectangular first openings 274 are formed in the first horizontal section 272 in the plan view, but the invention is not limited thereto. Alternatively, at least one first opening 274 having a semi-circular, semi-oval, circular, oval or polygonal shape in the plan view may be provided. The heat sink 260 is composed of a plurality of first heat sinks 270 wherein first vertical sections 271 and second horizontal sections 273 have a different length from each other. Moreover, the first heat sinks 270 with the first vertical sections 271 and the second horizontal sections 273 which have different lengths are provided to the system such that the second horizontal sections 273 contact each other. Here, the multiple first heat sinks 270 are disposed with ends of the second horizontal sections 273 being collinear with each other so that the first horizontal sections 272 and the first vertical sections 271 are spaced at predetermined intervals from each other, respectively. Accordingly, heat generated from the LED module and transferred to the second horizontal sections 273 of the first heat sinks 270 is discharged to the outside through the first vertical sections 271 and the first horizontal sections 272.

As in the first heat sinks 270, the second heat sink 280 includes a second vertical section 281, third horizontal section 282 and fourth horizontal section 283 which are bent and extend from opposite ends of the second vertical section 281. Further, the third horizontal section 282 of the second heat sink 280 is formed with a second opening 284 which accommodates the dehumidifying agent 291. In this embodiment, multiple rectangular second openings 284 are formed in the third horizontal section 282 when viewed in the plan view. It should be understood that not only the first openings 274 but also the second openings 284 may be formed in various numbers and different shapes. The second heat sink 280 is formed in the same shape as the first heat sinks 270 and combined with the first heat sink 270. Namely, the second heat sink 280 has a cornered C-shape, and the second vertical sections 281 of the second heat sinks 280 are coupled to the first vertical sections 271 of the first sinks 270 to adjoin each other, thereby forming the overall shape of the heat sink 260 of this embodiment.

The dehumidifying agent 291 serves to quickly discharge heat, transferred from the LED module to the heat sink 260, to the outside and may include lithium chloride (LiCl) or the like as in the first embodiment. The dehumidifying agent 291 is provided on the first horizontal section 272 having the first opening 274 and the third horizontal section 282 having the second opening 284 of the heat sink 260, in particular on both sides of the first horizontal section 272 and the third horizontal section 282 to maximize a moisture absorption area. An increase in moisture absorption area leads to improvement in moisture absorption capacity. The dehumidifying agent 291 absorbs moisture on both sides of the first horizontal section 272 and the third horizontal section 282, and absorbs heat from the first horizontal section 272 and the third horizontal section 282 while evaporating moisture therein with heat generated from the LED module and transferred to the heat sink, thereby decreasing temperature.

The filter 290 protects the dehumidifying agent 291 and may include a semi-transparent layer such as polytetrafluoroethylene (PTFE) or the like. That is, the filter 290 is adhered to both sides of the first horizontal section 272 having the first opening 274 which receive the dehumidifying agent 291 and the third horizontal section 282 having the second opening 284 which receive the dehumidifying agent 291, thereby protecting the dehumidifying agent 291. In this embodiment, an adherent member is used to bond the filter 290 to the heat sink 260, wherein high-temperature vinyl acetate or high-temperature epoxy is effective.

According to the embodiment, a thermal sheet may be additionally provided between the LED module and the heat sink 260. Here, the thermal sheet 30 serves to quickly transfer heat generated from the LED module to the heat sink 260.

Although some embodiments have been provided to illustrate the invention in conjunction with the drawings, it will be apparent to those skilled in the art that the embodiments are given by way of illustration only and that various modifications and changes can be made without departing from the spirit and scope of the present invention. Accordingly, it should be understood that the invention is not limited to the disclosed embodiments, but, on the contrary, is intended to cover various modifications and equivalent arrangements included within the spirit and scope of the accompanying claims, and equivalents thereof.

The results of these studies are summarized in detail below:

EXAMPLE 1

Figure 5:
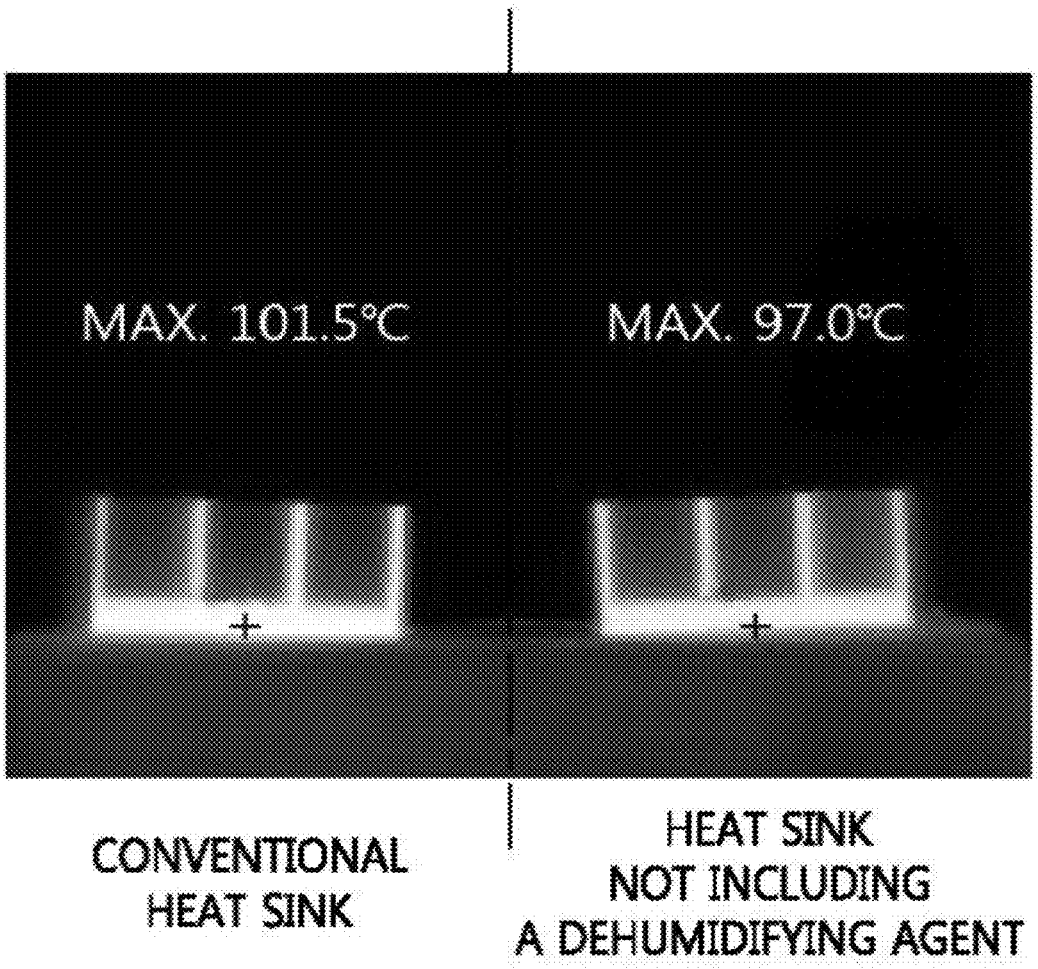
FIGS. 5 to 9 are temperature views comparing heat dissipation capability of heat sinks of conventional cooling systems and heat dissipation capability of heat sinks of inventive cooling systems.
Figure 6:
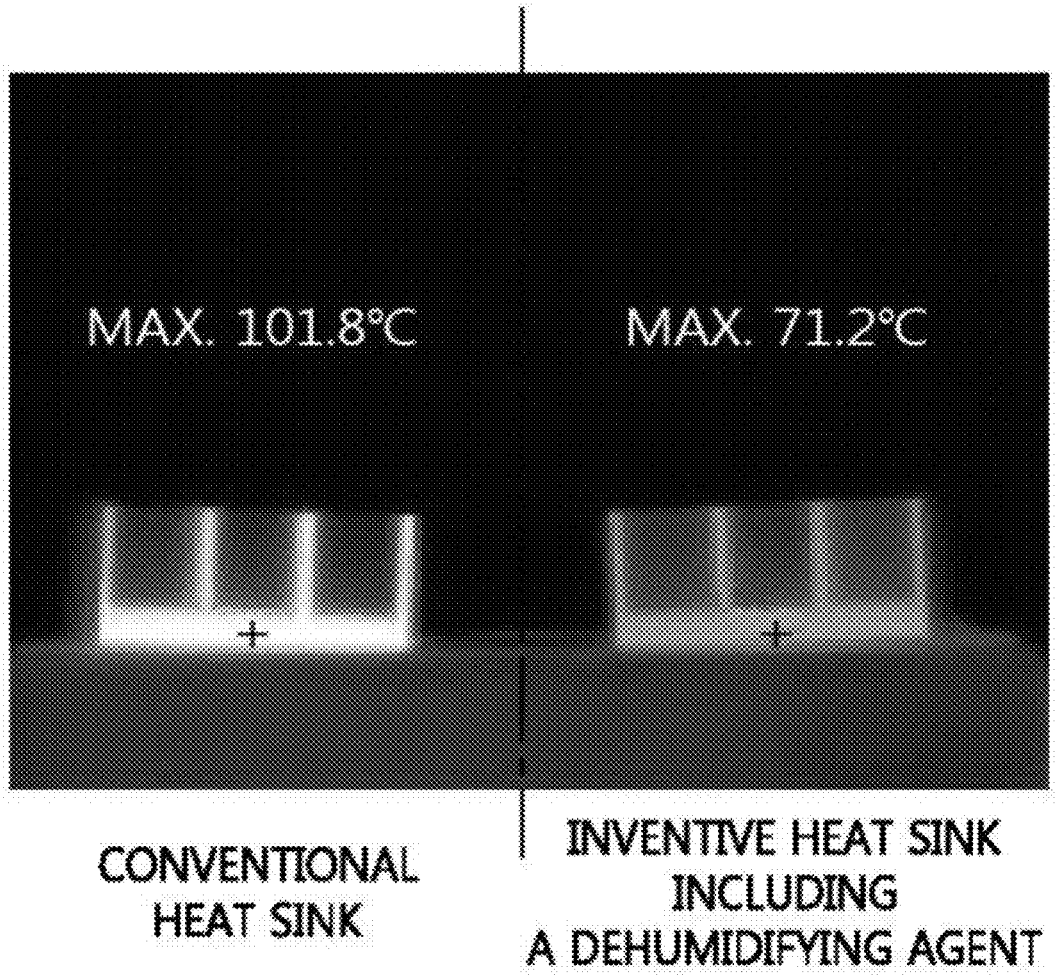

FIGS. 5 and 6 show heat distribution in a conventional heat sink using an incandescent lamp as a light source and in an inventive heat sink. A dehumidifying agent used for the experiment had a moisture absorption capacity of 208 g/m2·h at a temperature of 35° C. and humidity of 65%. In FIG. 5, the conventional heat sink and the inventive heat sink did not utilize a dehumidifying agent, and in FIG. 6, both the conventional heat sink and the inventive heat sink utilized a dehumidifying agent.

Referring to FIG. 5, the conventional heat sink exhibited a temperature of 101.5° C., thereby illustrating that the temperature increases to 100° C. or more despite the use of the heat sink. The heat sink where the dehumidifying agent was not used exhibited a temperature of 97.0° C. As a result, it can be seen that the conventional heat sink and the heat sink where the dehumidifying agent was not used have substantially the same heat dissipation capabilities.

Referring to FIG. 6, the conventional heat sink exhibited a temperature of 101.8° C., whereas the inventive heat sink where the dehumidifying agent was used exhibited a temperature of 71.2° C. As a result, it can be seen that the inventive heat sink employing the dehumidifying agent is lower than the conventional heat sink, which does not utilize the dehumidifying agent, by a maximum of 26° C. That is, the inventive heat sink employing the dehumidifying agent has superior heat dissipation capability to the conventional heat sink.

EXAMPLE 2

Figure 7:
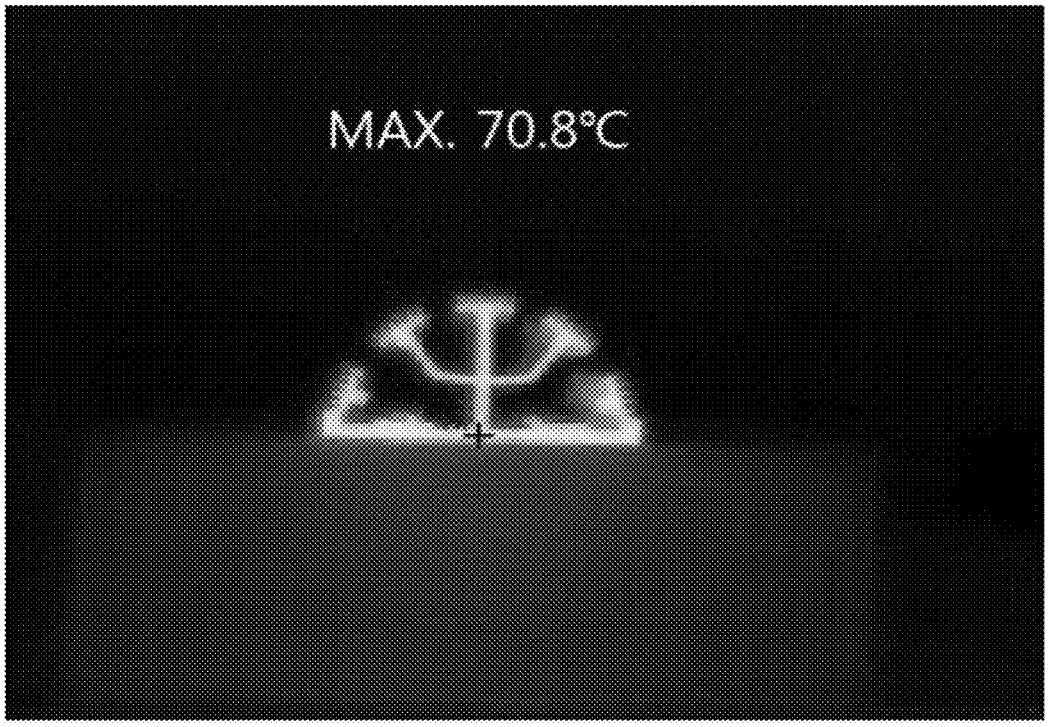
Figure 8:
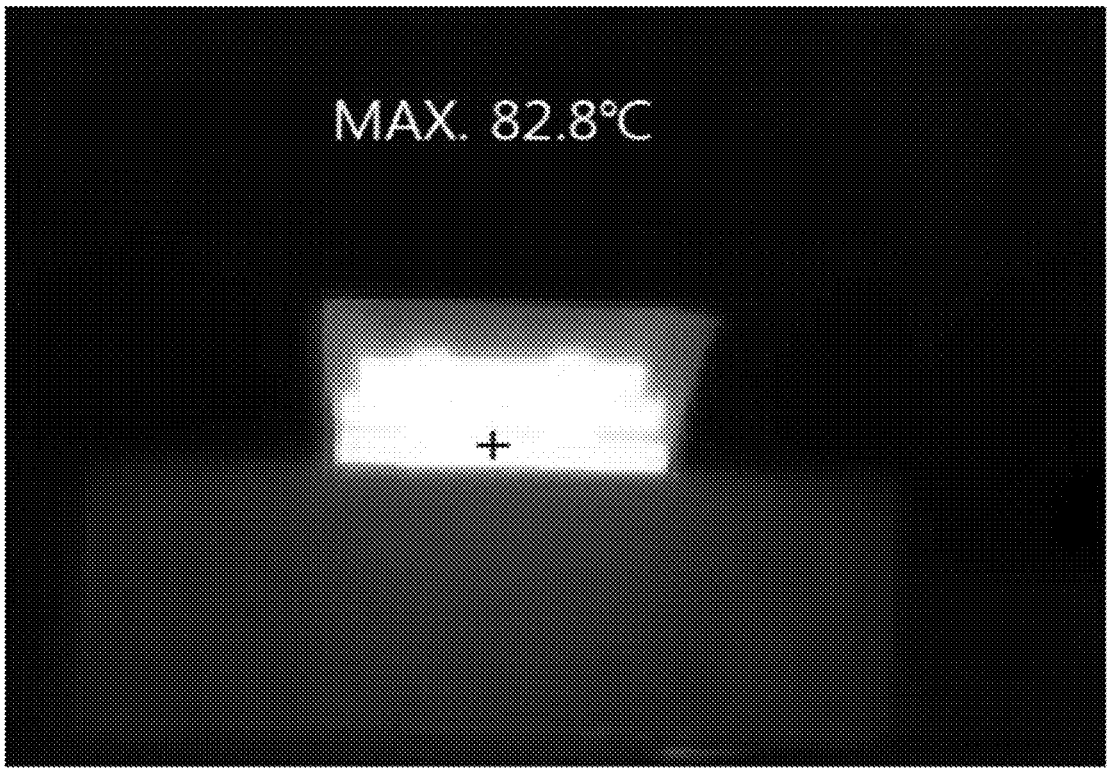
Figure 9:
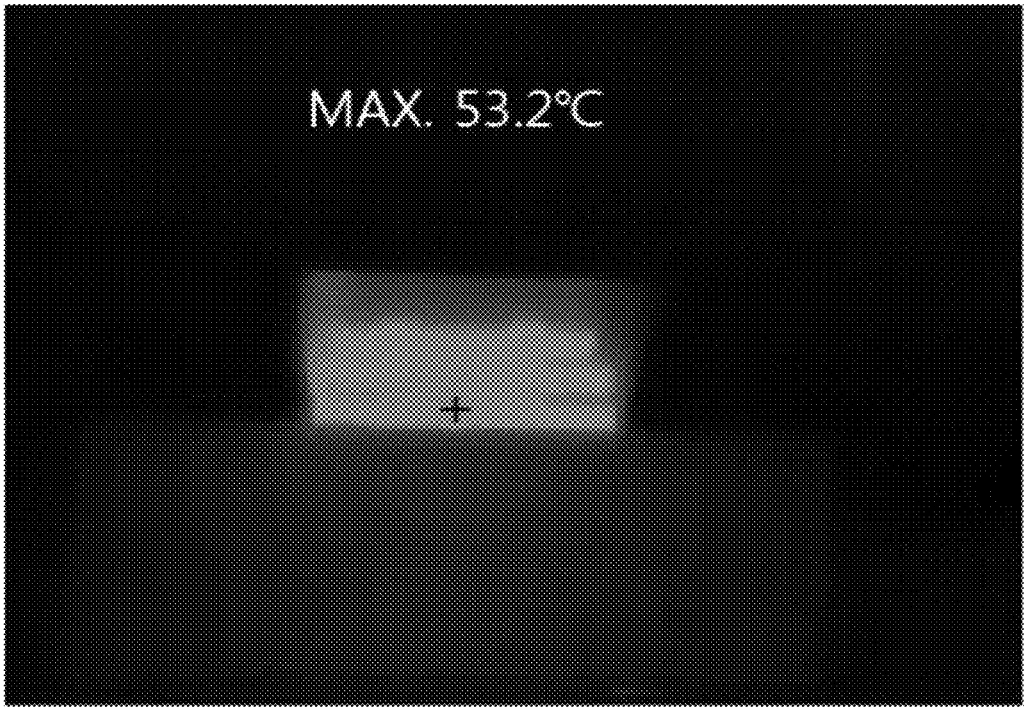
Figure 10:
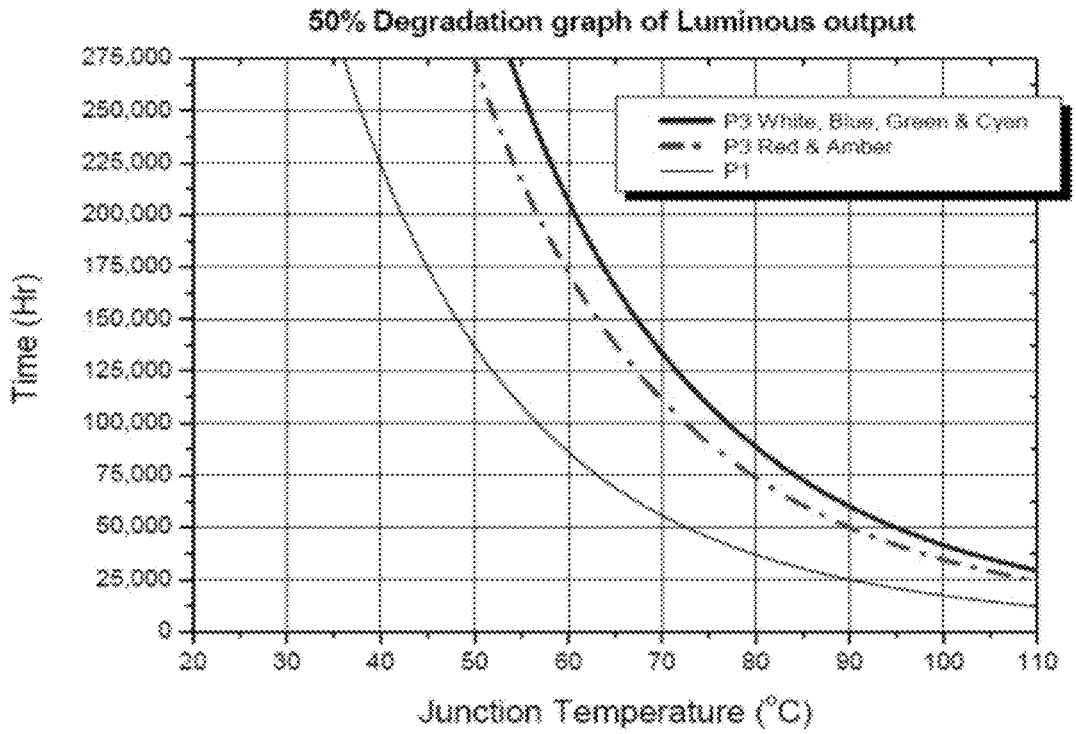
FIG. 10 is a graph depicting expected lifespan of LEDs according to temperature.

FIG. 7 shows heat distribution in a conventional heat sink which includes LEDs as a light source, FIG. 8 shows heat distribution in a heat sink which includes LEDs as a light source and do not includes a dehumidifying agent, FIG. 9 shows heat distribution in an inventive heat sink which includes LEDs as a light source and a dehumidifying agent, and FIG. 10 is a graph depicting lifespan of LEDs according to temperature.

FIG. 7 shows that the conventional heat sink including the LEDs as a light source exhibited 70.8° C. during operation of the LEDs. FIG. 8 shows that the heat sink including the LEDs as a light source and not including a dehumidifying agent exhibited 82.8° C. Further, FIG. 9 shows that the inventive heat sink including the LEDs as a light source and the dehumidifying agent exhibited 53.2° C.

Accordingly, since the inventive heat sink having the dehumidifying agent is about 18° C. lower than the conventional heat sink during operation of the light source, it can be seen that the inventive heat sing has superior heat dissipation capability.

The lifespan of LEDs used in the conventional heat sink and the inventive heat sinks can be estimated with reference to FIG. 10. In other words, the lifespan of LEDs according to temperature can be calculated by adding 15° C. to a temperature of the heat sink measured during operation of the LEDs and applying the result to the graph shown in FIG. 10.

When estimating the lifespan of LEDs according to temperature with reference to FIG. 10, the conventional heat sink exhibits 85.5° C. and thus an LED of the conventional heat sink has an expected life span of 75,000 hours. Further, the inventive heat sink exhibits 68.2° C., and thus an LED of the inventive heat sink has an expected life span of 150,000 hours, which is almost twice as long as the LED of the conventional heat sink. Thus, the inventive heat sink including the dehumidifying agent has superior heat dissipation capability to the conventional heat sink, and the LED of the inventive heat sink also has an increased lifespan.

What is claimed is:

1. A cooling system of a light emitting diode (LED) light using heat of vaporization, the LED light using an LED module including an LED as a light, the system comprising:

a heat sink;

a dehumidifying agent provided on the heat sink, the dehumidifying agent absorbing heat from the heat sink while evaporating moisture therein with heat generated by the LED module and transferred to the heat sink; and a dehumidifying sheet provided on the heat sink and accommodating the dehumdifying agent, the dehumidifying sheet comprising a case accommodating the dehumidifying agent.

2. The cooling system according to claim 1, wherein the dehumidifying agent comprises at least one of lithium chloride (LiCl), activated alumina, and zeolite.

3. The cooling system according to claim 1, further comprising:

a filter protecting the dehumidifying agent, the case accommodating the dehumidifying agent and the filter.

4. The cooling system according to claim 1, further comprising:

a thermal sheet disposed on the LED module;

a connector disposed on the thermal sheet; and a heat pipe transferring heat generated in the LED module from the thermal sheet to the connector.

5. The cooling system according to claim 4, wherein the heat pipe comprises a horizontal heat pipe section and vertical heat pipe sections bent and extending from opposite ends of the horizontal pipe, the vertical pipe sections penetrating the heat sink and the dehumidifying sheet.

6. The cooling system according to claim 5, wherein the heat pipe comprises multiple heat pipes disposed at regular intervals in a width direction of the LED module.

7. The cooling system according to claim 6, wherein the dehumidifying sheet is separately disposed between the vertical heat pipe sections being opposite to each other and outside the vertical heat pipe sections of the multiple heat pipes.

8. The cooling system according to claim 1, wherein the heat sink comprises:

a first heat sink that includes a first vertical section, and first and second horizontal sections bent and extending from opposite ends of the first vertical section; and a second heat sink that includes a second vertical section, and third and fourth horizontal sections bent and extending from opposite ends of the second vertical section, the first vertical section fixedly adjoining the second vertical section.

9. The cooling system according to claim 8, wherein the heat sink comprises a plurality of the first heat sinks and a plurality of the second heat sinks, the first vertical sections whose lengths are different from each other, the second horizontal section whose lengths are different from each other, the second vertical sections whose lengths are different from each other, and the fourth horizontal sections whose lengths are different from each other, and the first vertical section fixedly adjoining the second vertical section.

10. The cooling system according to claim 9, wherein the first horizontal section comprises a first opening formed therethrough, the third horizontal section comprises a second opening formed therethrough, and the dehumidifying agent is provided on both sides of the first horizontal section including the first opening and on both sides of the third horizontal section including the second opening.

11. The cooling system according to claim 10, further comprising:

a filter provided on the dehumidifying agent.

12. The cooling system according to claim 11, wherein the filter comprises a semi-transparent layer.

13. The cooling system according to claim 12, wherein the semi-transparent layer comprises polytetrafluoroethylene.

14. The cooling system according to claim 12, wherein further comprising:

an adherent member bonding the semi-transparent layer to the heat sink.

15. The cooling system according to claim 14, wherein the adherent member comprises one of high-temperature vinyl acetate, high-temperature epoxy, and room temperature vulcanizing (RTV) high-temperature silicone.

16. A light emitting diode (LED) light using heat of vaporization comprising:

an LED module; and a cooling system cooling the LED module and comprising a heat sink provided with a dehumidifying agent absorbing heat from the heat sink while evaporating moisture therein with heat generated by the LED module and transferred to the heat sink, wherein the cooling system further comprises a dehumidifying sheet provided on the heat sink and accommodating the dehumidifying agent, the dehumidifying sheet comprising a case accommodating the dehumidifying agent.

17. The LED light according to claim 16, wherein the dehumidifying sheet further comprises a filter coupled to the case to protect the dehumidifying agent.

18. The LED light according to claim 16, further comprising:

an opening formed in the heat sink; and a filter sealing the dehumidifying agent, the dehumidifying agent being provided on the heat sink comprising the opening.

19. The LED light according to claim 18, wherein the dehumidifying agent comprises lithium chloride (LiCl), and the filter comprises a semi-transparent layer.

* * * * *